252-104 AU 165 EX
3/29/77 OR 4,014,805

United States Patent [19]
Castrantas

[11] 4,014,805
[45] Mar. 29, 1977

[54] DRY CLEANING FORMULATION

[75] Inventor: Harry Marcus Castrantas, New Town, Pa.

[73] Assignee: FMC Corporation, Philadelphia, Pa.

[22] Filed: Nov. 28, 1975

[21] Appl. No.: 636,077

[52] U.S. Cl. ..... 252/104; 8/111; 8/142; 252/103
[51] Int. Cl.² ..... C11D 7/54
[58] Field of Search ..... 252/104, 1.3; 8/111, 8/111.5, 142

[56] References Cited

UNITED STATES PATENTS 3,838,967 10/1974 Shepley ..... 8/111

*Primary Examiner*—Mayer Weinblatt
*Attorney, Agent, or Firm*—Gary M. Nath; Frank Ianno; Pauline Newman

[57] ABSTRACT

Improved dry cleaning formulation containing a dry cleaning solvent, water, inorganic polyphosphate salt, hydrogen peroxide and a suitable detergent surfactant having a pH value of from 5 to 9, which minimizes equipment corrosion and maintains fabric strength while effectively removing hydrophilic stains.

9 Claims, No Drawings

DRY CLEANING FORMULATION

This invention relates to an improved dry cleaning formulation containing as its essential components hydrogen peroxide and a water-soluble inorganic polyphosphate salt.

The general technique for dry cleaning garments and other articles made of textile fibers, which are not resistant to ordinary washing with aqueous detergents, involves treating the textiles with a bath consisting of about 0.1 to 5% of a suitable detergent and a small amount of water, usually about 0.02 to 2.0%, both dispersed in a solvent such as a petroleum distillate, chlorinated solvent such as trichloroethylene, perchloroethylene, trifluorotrichloroethane or other highly halogenated solvent. About 5 to 20 times as much solvent bath is used per weight of fabric to insure proper cleaning which is generally carried out at room temperature for about 5 to about 20 minutes.

A major difficulty with conventional dry cleaning processes have been their inability to maintain garment whiteness and/or colored fabric brightness, particularly in polyester/cotton blended materials. In aqueous washing, liquid bleaches such as chlorine or hydrogen peroxide are conventionally used; but chlorine cannot be used in dry cleaning because it is corrosive to equipment and because rinses do not remove residual chlorinated compound remaining on the washed textile.

The art has recognized the problems associated with chlorine bleaches, and attempts have been made to introduce other bleaches, particularly volatile bleaches, such as hydrogen peroxide, into dry cleaning systems. Because dry cleaning is essentially a room temperature operation with contacting times being short, rather high hydrogen peroxide concentrations have been necessary, which concentrations result in excessive amounts of fabric degradation.

U.S. Pat. No. 3,635,667 discloses a process for obtaining acceptable whitening of white fabrics, approaching and equaling that of typical laundering with bleach without damage to the fabric, by using hydrogen peroxide, water, and a volatile alkali in controlled proportions in a dry cleaning bath. Ammonium hydroxide is disclosed as the preferred volatile alkali because of its availability. This alkali, however, is disadvantageous in view of its detectable odor and because it is not removed during the solvent distillation process used to reclaim the solvent. Other alkaline bases, such as sodium hydroxide, sodium silicate, and sodium carbonate have also been suggested which bases are preferably used to adjust the pH value of the bath to around 10.8. Use of a highly alkaline bath, however, is not desirable since it may cause skin irritation arising from residual base remaining on the cleaned fabric, and because it may cause odor problems which occur at pH values above 9 if amine containing detergents are employed, such as the isopropylamine salt of an alkyl-benzenesulfonate.

In view of these prior art developments, a need exists for a dry cleaning formulation which minimizes equipment corrosion, and maintains fabric strength while effectively removing water-soluble textile stains and maintaining garment whiteness and colored fabric brightners.

An improved dry cleaning formulation which achieves all of these long felt needs has been unexpectedly discovered which consists essentially of:

a. about 0.1% to about 30% by weight water;

b. about 0.08% to about 12% by weight water-soluble inorganic polyphosphate salt based on the weight of water;

c. about 0.003% to about 0.13% by weight hydrogen peroxide to provide about 0.05% to 2.0% by weight hydrogen peroxide W.O.F.;

d. about 0.1% to about 5% by weight of a suitable detergent; and e. the remainder being at least 69% by weight dry cleaning solvent; and having a pH value from 5.0 to 9.0.

The novel dry cleaning formulations of this invention contain a non-aqueous dry cleaning solvent in amounts of at least 69% and preferably about 96% to about 98.7% by weight of the dry cleaning formulation. Conventional solvents, such as petroleum distillates, Stoddard type solvents and halogenated dry cleaning solvents have been found useful. Preferred dry cleaning solvents are selected from the group consisting of perchloroethylene; trichloroethylene; 1,1,1-trichloro-2,2,2-trifluoroethane; methylchloroform; 1,1,2,2-tetrachloro-1,2-difluoroethane; trichlorofluoromethane; 1,1,2-trichloro-1,2,2-trifluoroethane; 1,1,1,2-tetrachloro-2,2-difluoroethane; 2,2,3-trichloro-1,1,1,3,3-pentafluoropropane; 1,2,2,3,3-pentachloro-1,1,3-trifluoropropane; and hexafluorodichlorobutene. Any surfactant which is capable of emulsifying the water present in the dry cleaning bath in the solvent, and which does not react with hydrogen peroxide or an inorganic polyphosphate salt is satisfactory. A wide range of anionic, cationic, and nonionic surfactants can be used. Exemplary surfactants are described in U.S. Pat. No. 3,635,667.

The water concentration of the dry cleaning formulation ranges from about 0.1% to about 30% by weight of the total formulation with amounts from 1% to 3% by weight of the total formulation preferred. Water concentrations between 3% and 30% while usable are not preferred since they place a heavy energy demand on the solvent distillation system used to reclaim contaminated dry cleaning solvent.

The formulations of this invention must contain sufficient amounts of hydrogen peroxide to provide about 0.05% to 2.0% by weight hydrogen peroxide based upon the weight of the fabric being cleaned (expressed as percent W.O.F.). This amount of hydrogen peroxide is provided by employing about 0.003% to about 0.13% by weight hydrogen peroxide (100% basis) in the formulation based upon the weight of the formulation. Preferably, sufficient amounts of hydrogen peroxide are employed to provide about 0.15% to 0.25% W.O.F. hydrogen peroxide, which amounts are provided by employing 0.01% to 0.017% by weight hydrogen peroxide (100% basis) based on the weight of the entire formulation. It is contemplated to be within the scope of the invention to employ other sources of hydrogen peroxide, such as sodium perborate, sodium carbonate peroxide, sodium pyrophosphate perhydrate, zinc peroxide, magnesium peroxide, calcium peroxide and urea peroxide.

The water-soluble inorganic polyphosphate salt is employed in sufficient amounts to enable the polyphosphate salt to remain soluble in the water present in the dry cleaning formulation, thus eliminating unnecessary and wasteful salt precipitation upon the textiles being cleaned. This amount may vary from about 0.08% to about 12% by weight inorganic polyphosphate salt based on the weight of the water present with 0.4% to 1.6% by weight preferred. These specific amounts are based upon the water present in view of the different inorganic polyphosphate salt water-solubility limits. For example, sodium tripolyphosphate is soluble in water at 25° to 50° C to the extent of about 15%, whereas tetrasodium pyrophosphate is 6% soluble in water at 25° C but 13% soluble at 50° C.

The preferred water-soluble inorganic polyphosphate salts are non-volatile compounds that are easily removed from the dry cleaning solvent during the distillation operation conventionally used to reclaim the dirty solvent. Exemplary inorganic polyphosphate salts include sodium tripolyphosphate, tetrasodium pyrophosphate, potassium tripolyphosphate, tetrapotassium pyrophosphate, sodium acid pyrophosphate, and glassy phosphates such as Hexaphos, Sodaphos and Glass-H, with sodium tripolyphosphate being preferred.

By employing small amounts of a water-soluble inorganic polyphosphate salt in a dry cleaning formulation containing hydrogen peroxide, significant improvements in stain removal occur, less fabric degradation is noted and a lower rate of equipment corrosion relative to what is normally found with hydrogen peroxide systems is achieved. While the amount of inorganic polyphosphate salt is based upon the amount of water present in the system, sufficient amounts of polyphosphate salt must be employed in the formulation in order to achieve the beneficial effects of the salt. These amounts range from about 0.002% to 0.3% by weight by the formulation, and preferably from 0.01% to 0.04%.

The dry cleaning formulations of this invention must have a pH value from 5.0 to 9.0, and preferably between 6.0 and 8.8. The pH value of the formulation is brought to these levels by addition of the inorganic polyphosphate salt, and if necessary, accompanied by the addition of other alkali, such as sodium hydroxide, sodium bicarbonate, and sodium carbonate preferably as aqueous alkaline solutions. The pH value of the bath must be kept above about 5.0 to avoid equipment corrosion. Likewise, the pH value of the bath must be kept below about 9.0 to prevent the formation of odors resulting from the reaction of the alkali with amine based surfactants, such as the isopropylamine salt of an alkylbenzenesulfonate.

Textile fabric is cleaned by contacting the textile with a dry cleaning solvent bath prepared by emulsifying at least 69% by weight of a dry cleaning solvent and about 1.0% to about 3.0% by weight water with a surfactant capable of emulsifying the water in said solvent and admixing the resulting emulsion with about 0.002% to 0.3% by weight of a water-soluble inorganic polyphosphate salt and a sufficient amount of hydrogen peroxide to provide 0.05% to 2.0% W.O.F. hydrogen peroxide. An aqueous alkaline solution is added if necessary to adjust the pH value of the bath from 5.0 to 9.0. The textile fabric is contacted with the dry cleaning bath for a sufficient time and temperature to complete the desired bleaching reaction. Typically, 5 to 120 minutes and preferably 5 to 20 minutes at temperatures from 20° to 55° C, and preferably from 25° to 40° C are sufficient to achieve maximum stain removal while maintaining fabric strength, garment whiteness and colored fabric brightners. Following the bleaching reaction, the textile fabric is rinsed, removed from the bath and dried, and optionally steam treated.

The invention will be better understood from a consideration of the following examples. All percentages are based upon weight unless otherwise indicated.

EXAMPLE 1

Inventive Runs 1 to 4, Comparative Runs A, B, C

This Example demonstrates the effectiveness of removing various stains from textile fabric with various dry cleaning formulations.

Fabric staining was carried out on 65/35 polyester/cotton white shirting fabric with durable press finish.

A. Dip Staining Procedure: 50 grams of coffee were added to 2 liters of water and boiled for 5 minutes. The coffee solution was then decanted from the coffee grounds and mixed with 128.5 grams fresh whole milk and 8 teaspoonsful of granulated sugar. Fabric pieces measuring 15.2 cm × 22.9 cm were dipped into the solution for 5 seconds, removed and air dried in a forced air oven at 82° C.

B. Spot Staining Procedure: 5 drops of whole human blood were dropped onto the center of a 15.2 cm × 15.2 cm piece of fabric. A piece of glassine paper, followed by a 5 pound weight were placed on the stain for 1 minute to remove excess fluid. The stained pieces were dried for 12 hours at 21° C at 65% relative humidity. The procedure was also used for preparing coffee stains.

C. Blueberry and Mustard Staining Procedure: Ground blueberries and commercially prepared mustard were applied to separate fabric pieces measuring 15.2 cm × 15.2 cm with a spatula, estimating a 5 drop quantity.

After staining, the fabric pieces were aged for about 7 days before dry cleaning. The fabric pieces to be dry cleaned were dipped in clear perchloroethylene for about 15 seconds prior to cleaning to prevent rapid absorption of water and hydrogen peroxide. The wet fabric pieces were then transferred to a Launder-o-meter jar (13.5 cm × 7.0 cm) containing the formulated solutions set forth in Table 1 having a solvent to fabric parts ratio of 15:1. The jar was rotated at 42 RPM for 15 or 30 minutes at 35° C. The fabric pieces were then removed, and excess liquid shaken off. The pieces were then dried in a forced air oven for 20 minutes at 82° C, followed by steaming at 100° C for 1 minute to destroy excess hydrogen peroxide.

An Elrepho reflectometer was used to read reflectance values of the spot stained fabrics. A Hunter Model D-40 reflectometer using a blue filter with the fluorescent exclusion switch on was used to read the dipped coffee stained fabric. The total percent of stain removal was determined using the formula:

$$\text{Total \% Stain Removal} = \frac{\text{Reflectance after bleaching} - \text{Reflectance (stained) before bleaching}}{\text{Reflectance unstained} - \text{Reflectance (stained) before bleaching}} \times 100$$

Results are set forth in Table 1. Table 1 shows that substantial improvement in stain removal is obtained with the formulations of this invention over water and hydrogen peroxide systems alone at high and low inorganic polyphosphate salt concentrations over a wide pH range. The improvement is also evident at short as well as long dry cleaning cycles. It should be noted that stain removal differences of two points or more based on an average of 4 different stains is considered significant. A negative percent stain removal represents a darkening of the stain.

EXAMPLE 2

Inventive Runs 5 and 6, Comparative Runs D and E

This Example demonstrates the improved results obtained with a water-soluble inorganic polyphosphate salt in lieu of ammonium hydroxide with hydrogen peroxide at pH values below 9.0.

The procedure of Example 1 was repeated using dipped coffee stains due to the wide popularity of this beverage and the difficulty of removing this stain with conventional dry cleaning formulations. The formulations and results are set forth in Table II. The fabric pieces were cleaned in one cycle for 30 minutes.

Table II shows that the hydrogen peroxide and water-soluble inorganic polyphosphate salt system is significantly better than the hydrogen peroxide and ammonium hydroxide system at both pH values.

EXAMPLE 3

Inventive Runs 7, 8, 9, Comparative Runs F, G, H

This Example compares fabric tensile strength retention with various fabric dry cleaned with various formulations.

The procedure of Example 1 was repeated with three different types of fabric that were dry cleaned 25 times at 35° C for 15 minutes per cycle. Tensile strengths were determined using the ASTM-D-1682-69 one inch cut strip test. All of the formulations contained 97.6% perchloroethylene, 0.49% isopropylamine salt of dodecylbenzenesulfonate (Atlas G-711) and 1.9% water. Results are set forth in Table III.

EXAMPLE 4

Inventive Run 10, Comparative Run I

This Example compares the effect of color fading from repeated dry cleaning cycles.

The procedure of Example 3 was repeated with 50/50 PE/C durable press fabric pieces. A Hunter D-25 reflectometer was used to determine color differences.

The results are set forth in Table IV. The results show that fabric colorfastness was excellent when treated with the inventive formulation.

The invention being thus described, it will be obvious that the same may be varied in many ways. Such variations are not to be regarded as a departure from the spirit and scope of the invention, and all such modifications are intended to be included within the scope of the following claims.

TABLE I

| Example I | Wt % Solvent | Wt % ABS* Surfactant | Wt % $H_2O$ | Wt % of 11.8% $H_2O_2$ | Wt % STPP** | pH | % Stain Removal Blood | Coffee | Blue-berry | Mustard | (No) and Length of Cycles |
|---|---|---|---|---|---|---|---|---|---|---|---|
| Comparative | | | | | | | | | | | |
| Run A | 97.6 | 0.49 | 1.9 | 0 | 0 | 6.7 | 1 | 28 | 42 | 62 | (1) 30 |
| Run B | 97.6 | 0.49 | 1.8 | 0.14 | 0 | 6.9 | 4 | 35 | 54 | 61 | (1) 30 |
| Run C | 97.6 | 0.49 | 1.9 | 0 | 0.12 | 8.6 | −5 | 48 | 40 | 50 | (1) 30 |
| Inventive | | | | | | | | | | | |
| Run 1 | 97.5 | 0.48 | 1.8 | 0.14 | 0.12 | 8.6 | −4 | 71 | 73 | 66 | (1) 30 |
| Run 2 | 97.9 | 0.49 | 1.4 | 0.14 | 0.02 | 6.0 | 0 | 40 | 46 | 74 | (1) 15 |
| Run 3 | 97.9 | 0.49 | 1.4 | 0.14 | 0.02 | 6.0 | 8 | 59 | 79 | 82 | (2) 15 |
| Run 4 | 97.9 | 0.49 | 1.4 | 0.14 | 0.02 | 6.0 | 25 | 68 | 92 | 88 | (4) 15 |

*Isopropylamine salt of dodecylbenzenesulfonate (Atlas G-711)
**Sodium tripolyphosphate

TABLE II

| Example II | Wt % Solvent | Wt % ABS* Surfactant | Wt % Water | Wt % of 11.8% $H_2O_2$ | Base | pH | % Coffee Stain Removal |
|---|---|---|---|---|---|---|---|
| Inventive Run 5 | 97.7 | 0.49 | 1.6 | 0.12 | STPP | 7.0 | 60 |
| Comparative Run D | 97.7 | 0.49 | 1.6 | 0.12 | $NH_4OH$ | 7.3 | 21 |
| Inventive Run 6 | 97.7 | 0.49 | 1.6 | 0.12 | STPP | 8.6 | 60 |
| Comparative Run E | 97.7 | 0.49 | 1.6 | 0.12 | $NH_4OH$ | 8.3 | 52 |

*Isopropylamine salt of dodecylbenzenesulfonate (Atlas G-711)

TABLE III

| Example III | Wt % of 11.8% $H_2O_2$ | Wt % STPP | pH | Type Fabric | Tensile Strength Pounds/inch² (average 5 strips) | % Standard Deviation | Elongation | % Standard Deviation |
|---|---|---|---|---|---|---|---|---|
| Control | 0 | 0 | 6.7 | 65/35 PE/C | 48.9 | 0.82 | 0.82 | 0.04 |
| Comparative Run F | 0.14 | 0 | 6.9 | " | 48.3 | 0.85 | 0.85 | 0.06 |
| Inventive Run 7 | 0.14 | 0.02 | 6.0 | " | 50.5 | 0.87 | 0.87 | 0.04 |
| Control | 0 | 0 | 6.7 | 100% Cotton | 88.3 | 0.62 | 0.62 | 0.01 |
| Comparative Run G | 0.14 | 0 | 6.9 | " | 76.2 | 0.58 | 0.58 | 0.02 |
| Inventive Run 8 | 0.14 | 0.02 | 6.0 | " | 95.4 | 0.51 | 0.51 | 0.02 |

TABLE III-continued

| Example III | Wt % of 11.8% $H_2O_2$ | Wt % STPP | pH | Type Fabric | Tensile Strength Pounds/inch² (average 5 strips) | % Standard Deviation | Elongation | % Standard Deviation |
|---|---|---|---|---|---|---|---|---|
| Control | 0 | 0 | 6.7 | 100% ALMI™ Cotton | 76.1 | 0.31 | 0.31 | 0.01 |
| Comparative Run H | 0.14 | 0 | 6.9 | " | 70.7 | 0.30 | 0.30 | 0.02 |
| Inventive Run 9 | 0.14 | 0.02 | 6.0 | " | 86.7 | 0.26 | 0.26 | 0.01 |

TABLE IV

| Example IV | Wt % of 11.8% $H_2O_2$ | Wt% STPP | Total Color Difference | | |
|---|---|---|---|---|---|
| | | | Blue | Pink | Green |
| Control | 0 | 0 | 12.4 | 3.7 | 3.0 |
| Comparative Run I | 0.14 | 0 | 12.0 | 4.0 | 2.0 |
| Inventive Run 10 | 0.14 | 0.02 | 11.8 | 3.4 | 2.2 |

What is claimed is:

1. An improved dry cleaning formulation which minimizes equipment corrosion and maintains fabric strength while effectively removing hydrophilic stains consisting essentially of:

a. about 0.1% to about 30% by weight water;

b. about 0.08% to about 12% by weight water-soluble inorganic polyphosphate salt based on the weight of water;

c. about 0.003% to about 0.13% by weight hydrogen peroxide to provide about 0.05% to 2.0% W.O.F. hydrogen peroxide;

d. about 0.1% to about 5% by weight of a suitable detergent capable of emulsifying the water present in the dry cleaning bath in the solvent and which does not react with hydrogen peroxide or an inorganic polyphosphate salt; and e. the remainder being at least 69% by weight non-aqueous dry cleaning solvent; and having a pH value from 5.0 to 9.0.

2. The formulation of claim 1 wherein the dry cleaning solvent is selected from the group consisting of: perchloroethylene; trichloroethylene; 1,1,1-trichloro-2,2,2-trifluoroethane; methylchloroform; 1,1,2,2-tetrachloro-1,2-difluoroethane; trichlorofluoromethane; 1,1,2-trichloro-1,2,2-trifluoroethane; 1,1,1,2-tetrachloro-2,2-difluoroethane; 2,2,3-trichloro-1,1,1,3,3-pentafluoropropane; 1,2,2,3,3-pentachloro-1,1,3-trifluoropropane; and hexafluorodichlorobutene.

3. The formulation of claim 1 containing about 96% to about 98.7% by weight of said dry cleaning solvent.

4. The formulation of claim 1 containing 1% to 3% by weight of water.

5. The formulation of claim 1 containing 0.4% to 1.6% by weight inorganic polyphosphate salt based on the weight of water.

6. The formulation of claim 1 containing 0.01% to 0.017% by weight hydrogen peroxide to provide about 0.15% to 0.25% W.O.F. hydrogen peroxide.

7. The formulation of claim 1 wherein the water-soluble inorganic polyphosphate salt is selected from the group consisting of sodium tripolyphosphate, tetrasodium pyrophosphate, potassium tripolyphosphate, tetrapotassium pyrophosphate, sodium acid pyrophosphate, and glassy phosphates.

8. An improved dry cleaning formulation which minimizes equipment corrosion and maintains fabric strength while effectively removing hydrophilic stains consisting essentially of:

a. about 96 to about 98.7% by weight dry cleaning solvent;

b. 1% to 3% by weight water;

c. 0.4% to 1.6% by weight water-soluble inorganic polyphosphate salt based on the weight of water;

d. 0.01% to 0.017% by weight hydrogen peroxide to provide 0.15% to 0.25% W.O.F. hydrogen peroxide;

e. 0.25% to 0.75% by weight of a suitable detergent surfactant; and having a pH value of 6.0 to 8.8.

9. A process for cleaning textile fabric, which comprises:

contacting the textile fabric with a dry cleaning solvent bath prepared by emulsifying at least 69% by weight of a non-aqueous dry cleaning solvent and about 1.0% to about 3.0% by weight water with a surfactant capable of emulsifying the water in said solvent; admixing the resulting emulsion with about 0.002% to 0.3% by weight of a water-soluble inorganic polyphosphate salt and a sufficient amount of hydrogen peroxide to provide 0.05% to 2.0% W.O.F. hydrogen peroxide; maintaining the textile fabric in contact with the dry cleaning bath until the desired bleaching reaction is completed; and recovering a cleaned textile fabric.

* * * * *